US006389981B1

(12) United States Patent
Strothmann et al.

(10) Patent No.: US 6,389,981 B1
(45) Date of Patent: May 21, 2002

(54) TROLLEY FOR TRACK SYSTEMS

(75) Inventors: Wilfried Strothmann, deceased, late of Schloss Holte-Stukenbrock, by Maike Strothmann, Kai Michael Strothmann, legal representatives; Rainer Massow, Schloss Holte-Stukenbrock; Friedhelm Heinze, Bielefeld, all of (DE)

(73) Assignee: Wilfred Strothmann GmbH & Co. KG, Mashinenbau und Handhabungstechnik, Schloss Holte-Stukenbrock (DE)

( * ) Notice: Subject to any disclaimer, the term of this patent is extended or adjusted under 35 U.S.C. 154(b) by 0 days.

(21) Appl. No.: 09/855,892

(22) Filed: May 15, 2001

(30) Foreign Application Priority Data

May 16, 2000 (DE) ..... 100 23 977

(51) Int. Cl.[7] ..... B60S 13/02
(52) U.S. Cl. ..... 104/48; 104/130.01

(58) Field of Search ..... 104/48, 50, 106, 104/107, 130.01, 141; 246/415 R, 454, 465

(56) References Cited

U.S. PATENT DOCUMENTS

| | | | | |
|---|---|---|---|---|
| 3,408,950 A | * | 11/1968 | Puhringer | 104/141 |
| 3,845,718 A | * | 11/1974 | Rogers et al. | 104/130 |
| 5,044,283 A | * | 9/1991 | Marie et al. | 104/88 |
| 5,857,413 A | * | 1/1999 | Ward | 104/48 |

* cited by examiner

*Primary Examiner*—S. Joseph Morano
*Assistant Examiner*—Robert J. McCarry, Jr.
(74) *Attorney, Agent, or Firm*—Richard M. Goldberg

(57) ABSTRACT

A trolley for track systems with essentially right-angled intersections is equipped with raisable and lowerable rollers which can be lowered to engage with, and raised to disengage with, one of the pairs of tracks. A common actuator (76,78) simultaneously lowers, in relation to the trolley, the rollers associated with one pair of tracks and raises the rollers associated with the intersecting pair of tracks.

12 Claims, 4 Drawing Sheets

16
46
30
28
44
20
24
36
40
74
72
68
62
82
42
70
38
80
78
84
76
22
26
34
50
64
48
32
18
66
10
12
14
86
88

78
76
10
12
50
66
48
14

10
16
20
22
18

TROLLEY FOR TRACK SYSTEMS

BACKGROUND OF THE INVENTION

This invention relates to a trolley for track systems with essentially right-angled intersections, with raisable and lowerable rollers on the trolley for alternatively engaging with one pair of the intersecting pairs of tracks.

This invention is especially applicable to track systems with tracks having a circular cross-section that are largely sunk into the ground, as described in DE 43 18 383 CI. These types of track systems can e.g. be laid in a works hall without creating any major obstacle to walking or driving over the floor of the hall. They also have a very high load-bearing capacity, making them particularly suitable for transport work in industrial halls.

In order to make use of the entire surface area of the hall, the tracks usually have to be laid in a grid with right-angled intersections. The transition from one pair of tracks to another pair of tracks intersecting at a right angle is achieved by raising the rollers associated with the first pair of tracks, and simultaneously lowering, in relation to the trolley, the rollers on the trolley associated with the intersecting pair of tracks. This ensures that only the rollers associated with the intersecting pair of tracks engage with these latter tracks. Given that in certain circumstances, the said changeover process has to be effected with high or very high loads, it has proved difficult to create a hard-wearing, durable changeover device that is nonetheless as simple as possible and designed to ensure that the changeover process can be carried out as quickly as possible.

SUMMARY OF THE INVENTION

The invention is therefore based on the task of creating a trolley of the above-mentioned type with a changeover device for the rollers which allows the rollers to be raised and lowered virtually simultaneously and with relatively little application of force.

According to the invention, this task is solved by a trolley of the above type which is characterized in that an actuator is provided for simultaneously raising, in relation to the trolley, the rollers which engage with one pair of tracks and lowering, in relation to the trolley, the rollers which engage with the intersecting pair of tracks.

The changeover system according to the invention therefore comprises only one actuator, e.g. a hydraulic cylinder, a spindle drive or similar.

The trolleys of the type in question here are generally equipped, in a quadratic arrangement overall, on all four sides and in the vicinity of the ends of these sides, with rollers or roller groups comprising two or three rollers.

According to the invention, these rollers or roller groups are preferably mounted on the underside of the trolley by means of suspension arms, and more specifically in such a way that a pulling or pushing force in the direction along the side edges causes the suspension arms to pivot, thereby raising or lowering the rollers or roller groups. This means that the vertical adjustment of the rollers or roller groups can be effected by exerting an appropriate pushing or pulling force on the roller groups, e.g. from a position in the middle of each of the side edges.

The central actuator preferably acts on two intersecting shafts which are mounted on the trolley, are coupled via a bevel gear system and each extend from side-middle to side-middle, i.e. end up between the two rollers or roller groups on the four sides of the contour of the trolley.

Advantageously attached to these ends there are double levers, each end of which is pivotably connected to a rod which is pivotably connected by its other end to a roller or roller group. By rotating the shafts and pivoting the double levers correspondingly, a pulling or pushing force can be exerted via the rods in the direction of the rollers or roller groups. The pulling or pushing force lowers or raises the rollers in relation to the trolley, the rollers being, as already mentioned, pivotably mounted on the trolley by means of suspension arms.

The suspension arms of the rollers or roller groups and the double levers of the shafts are preferably arranged so that when the rollers or roller groups are lowered, the suspension arms point vertically downwards and the double levers assume a horizontal position. In this way the suspension arms are subject to upwardly directed push along their longitudinal direction and any deflected lateral forces which might act on the suspension arms under heavy loads are absorbed by the double levers in their longitudinal direction. Both stress directions are extremely advantageous from the kinematic point of view, and, in particular, prevent the drive together with the shaft system from having to exert significant holding torque in order to absorb the stress of the lowered rollers.

There is another advantage to said arrangement of the suspension arms and the double levers. This has to do with the fact that the rods disposed between the double levers and the rollers or roller groups are not displaced linearly, but execute circular movements. Because of the said arrangement, the horizontal component of the rods is relatively large at the beginning of the lowering movement as the rollers or roller groups are lowered onto the tracks, whilst the horizontal component then becomes smaller and smaller as the double levers rotate. On the other hand, the vertical component of the rollers or roller groups is also relatively large at the beginning of the lowering movement of the roller groups or rollers, whilst it decreases progressively towards the end of the lowering movement. The result is that when the rollers or roller groups are changed, the lowering movement of the rollers for one of the pairs of tracks precedes the raising movement of the rollers of the other pair of tracks. This means the trolley is supported by the new rollers relatively quickly, so that it loses virtually no height when the rollers are changed. Having to lift the trolley up again after any loss of height would require enormous force and an actuator of a corresponding size if the trolley were heavily loaded.

BRIEF DESCRIPTION OF THE DRAWINGS

Preferred examples of embodiments of the invention will be explained in more detail below with reference to the drawings, in which.

DETAILED DESCRIPTION

Figure 1:
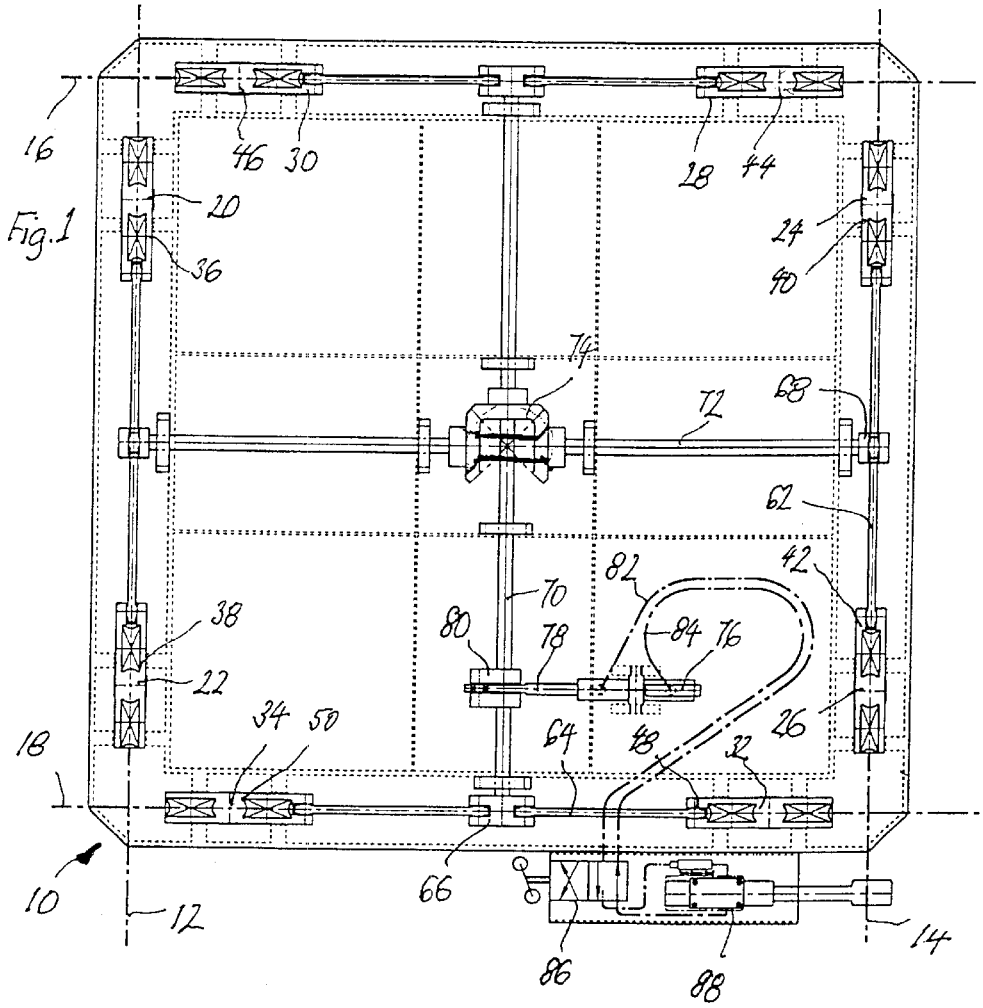
FIG. 1 shows a diagrammatic top plan view onto a trolley according to the invention, which is presented as transparent.
Figure 2:
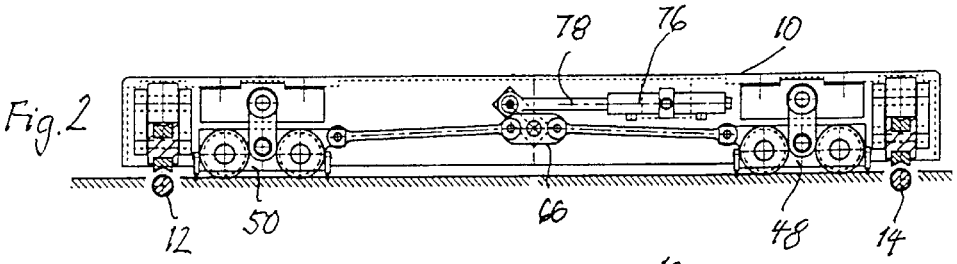
FIG. 2 is a view of the bottom of FIG. 1, also showing only the outline of the trolley.
Figure 3:
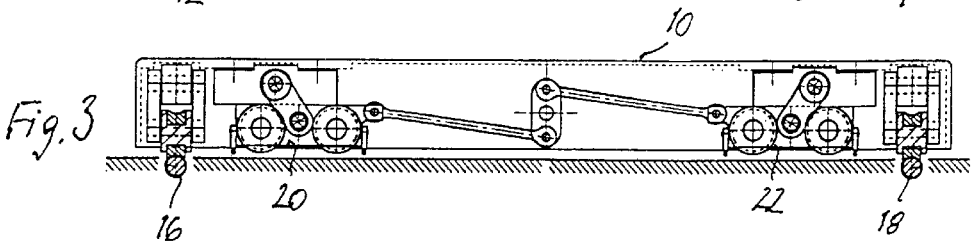
FIG. 3 shows a view of the left side of FIG. 1, using the same type of presentation as for FIG. 2.

In FIG. 1, an overall trolley is designated as 10. It forms an essentially quadratic platform, but is only hinted at in its outline in the drawing, as the details below refer solely to the changeover rollers disposed underneath the trolley. Two intersecting pairs of tracks are designated in the drawing by 12,14 and 16,18. In FIG. 1, the tracks are shown only as dash-dotted lines. On each of tracks 12 and 14 as per FIG. 1 there are two roller groups 20,22 and 24,26, each with two rollers which are not designated separately. The pairs of rollers are disposed on the individual sides at a distance from each other in the vicinity of the corners of the trolley.

Figure 4:
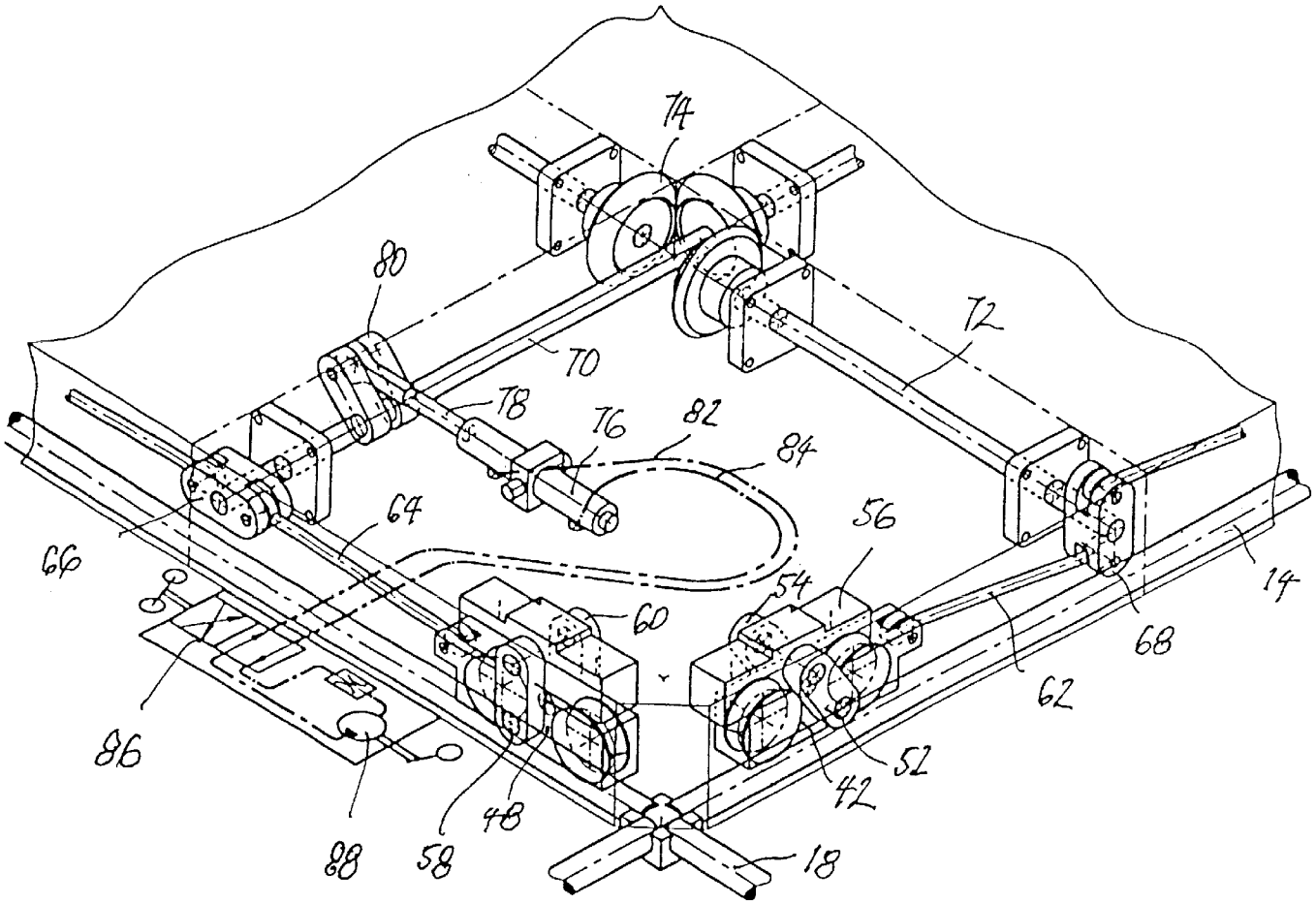
FIG. 4 is an isometric partial representation of the actuator according to the invention.

On the top and bottom sides as shown in FIG. 1 there are corresponding tracks 16,18, on which are disposed pairs of rollers 28,30 and 32,34, which also comprise two rollers arranged one behind the other, but not designated separately. The rollers of the individual roller groups are mounted in roller supports 36,38,40,42 and 44,46,48,50. These roller supports 36 50 are suspended on both sides with the help of suspension arms 52,54 (FIG. 4) from a rigid construction part 56 of the trolley which is not shown in more detail. The isometric view shown in FIG. 4 relates to the bottom right corner of trolley 10 as per FIG. 1. Whilst the suspension arms 52,54 of roller support 42 of roller group 26 in the bottom right of FIG. 4 adopt an inclined position, the corresponding suspension arms 58,60 of roller group 32 shown on the left in FIG. 4 are directed vertically downwards. This slight pivoting movement of the suspension arms causes the roller group 32 shown on the left to lie fixed on track 18, whilst roller group 26 on the right of FIG. 4 is raised off track 14.

As is clearly shown in FIG. 4, the two roller supports 42 and 48 can be displaced horizontally by means of rods 62 and 64, which are pivotably connected to the roller supports on the one hand, and pivotably connected to one end of double levers 66,68 on the other hand.

Double levers 66,68 are attached to the ends of shafts 70,72, which intersect in a bevel gear system 74 in the centre of trolley 10 and divide the overall surface area of the trolley into four equal squares. Shafts 70 and 72 are synchronously connected by means of the bevel gear system.

The central actuator is a hydraulic cylinder 76, whose piston rod 78 works together with the free end of a lever 80 which is rigidly attached to shaft 70. The piston movement of hydraulic cylinder 76 therefore simultaneously rotates both shaft 70 and, via bevel gear system 74, the other shaft 72 as well. As the two double levers 68 on the ends of shaft 72 are positioned vertically, and the two double levers 66 on the ends of shaft 70 are positioned horizontally, roller supports 44,46 and 48,50 are raised, and roller supports 36,38,40,42 are lowered. Hydraulic cylinder 76 is connected via two lines 82,84 with a two-way valve 86 which can supply the oil flow from a hydraulic pump 88 to hydraulic cylinder 76 in both directions.

The invention is not limited in its application to tracks with a round cross-section, or to grooved rollers as shown in the drawings.

The trolley according to the invention is particularly suited to being controlled from the floor of the works hall. Rotatable positioning elements can, for example, be contrived in the floor of the hall in the centres of the intersections, which can engage with engaging elements on the underside of the trolleys when a trolley is positioned above an intersection. In this way roller groups 20,22,24,26 on two parallel sides of a trolley can be lowered via the floor of the hall, and roller groups 28,30,32,34 on the other two parallel edges of a trolley can be raised so that the trolley changes direction by $\mathbf{90}_i$.

Figure 5:
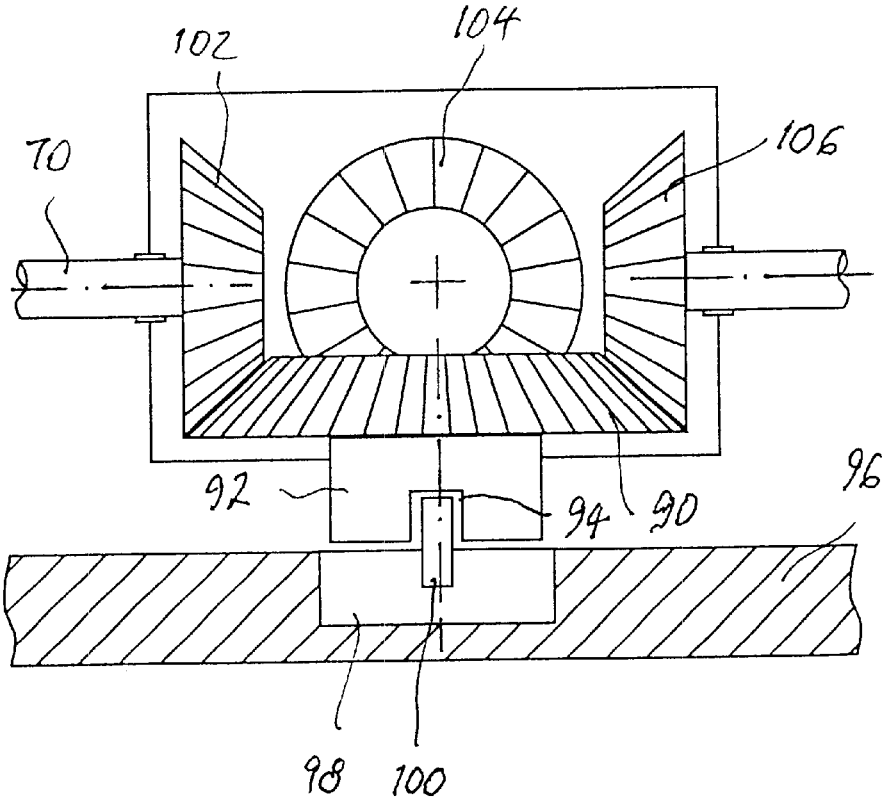
FIG. 5 is a partial representation of the changeover mechanism of another embodiment.
Figure 6:
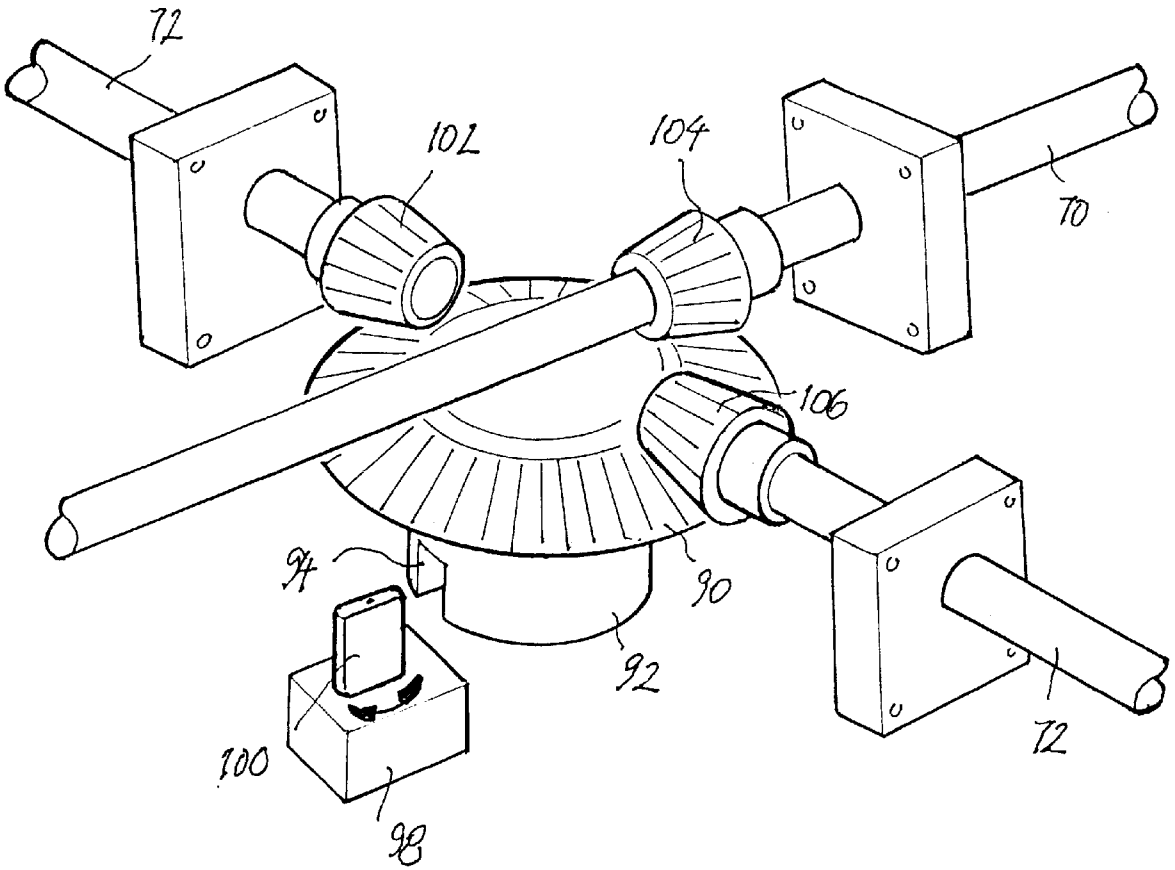
FIG. 6 illustrates a modification to FIG. 5.

FIGS. 5 and 6 illustrate diagrammatically how this can happen.

Instead of the three intermeshing bevel wheels of the bevel gear system 74 of the embodiment described above, one bevel wheel 90 is mounted on the underside of a trolley such that it can rotate around a vertical axis. The underside of this bevel wheel 90 is provided with an engaging element 92, which in turn is provided on its underside with an engaging profile 94, e.g. in the form of a screw slot. In the floor 96 of the hall there is a rotary actuator 98 which is able to rotate a positioning element 100, which can be shaped e.g. like a screwdriver blade, by $\mathbf{90}_i$ in both directions.

The shape of engaging element 92 and positioning element 100 may be different, but should not pose an obstacle to walking or driving over the floor of the hall in general. When a trolley is driven over an intersection, positioning element 100 engages in the slot of engaging profile 94. If rotary movement is then imparted to rotary actuator 98, bevel wheel 90 can be rotated by $\mathbf{90}_i$. Engaging with the bevel wheel from four sides are bevel wheels 102,104,106, which are attached to shafts 70,72, which are contrived here as split half-shafts in the two intersecting directions. These bevel wheels 102,104,106 mesh with horizontal bevel wheel 90. In contrast to the first embodiment they do not engage with each other. They therefore rotate in the same direction, and not in opposite directions, as in the first embodiment. This needs to be taken into account in relation to the arrangement of the subsequent control mechanisms.

It is therefore not necessary to equip each individual trolley with its own transmitting and receiving system or such like for the purpose of remote control inside a hall because the trolleys are controlled by means of a positioning system laid in the floor of the hall.

FIG. 6 also relates to the embodiment shown in FIG. 5, but differs from the variant as per FIG. 5 in that instead of four half-shafts, there is one continuous shaft 70 and two half-shafts 72 which transmit the rotation of bevel wheels 102,104,106 to the changeover mechanisms as was the case in the first embodiment. In both cases, the subsequent elements of the changeover mechanisms have to be adapted to the direction of rotation of the bevel wheels.

What is claimed is:

1. A trolley for track systems with essentially right-angled intersections, comprising:

raisable and lowerable rollers on the trolley for alternatively engaging with one pair of intersecting pairs of tracks of a track system, and an actuator for simultaneously raising, in relation to the trolley, the rollers which engage with one pair of tracks, and lowering, in relation to the trolley, the rollers which engage with the intersecting pair of tracks.

2. The trolley of claim 2, wherein the rollers are mounted on the trolley by means of suspension arms in such a way that a horizontal pushing or pulling force lifts or lowers the rollers in relation to the trolley.

3. The trolley of claim 1, wherein for each pair of tracks there are at least two rollers spaced at a distance.

4. The trolley of claim 3, wherein the actuator drives two intersecting shafts mounted on the trolley and is coupled to the shafts via a bevel gear system, each of said shafts extending between said at least two rollers for the individual tracks in a central portion of four sides of the trolley and bearing double levers at ends thereof which, when the shafts are rotated, exert a pulling force on the at least two rollers for one of the pairs of tracks, and a pushing force on the at least two rollers of the other pair of tracks.

5. The trolley of claim 4, wherein the ends of the double levers are each connected to one end of a rod whose other end is connected to roller supports for the at least two rollers and exert a pulling or pushing force on the latter when the shafts are rotated and the double levers pivoted.

6. The trolley of claim 5, wherein the rollers are mounted on the trolley by means of suspension arms in such a way that a horizontal pushing or pulling force lifts or lowers the rollers in relation to the trolley and the double levers on the ends of the shafts are arranged in relation to the suspension arms of the at least two rollers so that the double levers are positioned in the direction of the rods when the suspension arms are directed downwards, while the double levers are positioned vertical to the rods when the suspension arms are pivoted out of the position in which they are directed vertically downwards.

7. The trolley of claim 1, wherein the actuator is a hydraulic cylinder.

8. The trolley of claim 1, wherein two rollers at a time are mounted on a common roller support.

9. The trolley of claim 2, wherein for each pair of tracks there are at least two rollers spaced at a distance.

10. The trolley of claim 9, wherein the actuator drives two intersecting shafts mounted on the trolley and is coupled to the shafts via a bevel gear system, each of said shafts extending between said at least two rollers for the individual tracks in a central portion of four sides of the trolley and bearing double levers at ends thereof which, when the shafts are rotated, exert a pulling force on the at least two rollers for one of the pairs of tracks, and a pushing force on the at least two rollers of the other pair of tracks.

11. The trolley of claim 10, wherein the ends of the double levers are each connected to one end of a rod whose other end is connected to roller supports for the at least two rollers and exert a pulling or pushing force on the latter when the shafts are rotated and the double levers pivoted.

12. The trolley of claim 11, wherein the double levers on the ends of the shafts are arranged in relation to the suspension arms of the at least two rollers so that the double levers are positioned in the direction of the rods when the suspension arms are directed downwards, while the double levers are positioned vertical to the rods when the suspension arms are pivoted out of the position in which they are directed vertically downwards.

* * * * *